US005553329A

United States Patent [19]

Casartelli

[11] Patent Number: 5,553,329

[45] Date of Patent: Sep. 10, 1996

[54] CRASH HELMET FOR MOTORCYCLISTS AND THE LIKE, PROVIDED WITH A SAFETY DEVICE FOR LOCKING THE VISOR

[75] Inventor: Gabriele Casartelli, Clamart, France

[73] Assignee: E.D.C. Sarl, Issy les Moulineaux, France

[21] Appl. No.: 456,933

[22] Filed: Jun. 1, 1995

[30] Foreign Application Priority Data

Jun. 7, 1994 [EP] European Pat. Off. ..... 94401253

[51] Int. Cl.[6] ..... A42B 3/18

[52] U.S. Cl. ..... 2/424

[58] Field of Search ..... 2/9, 10, 15, 424, 2/425, 422, 410, 411

[56] References Cited

U.S. PATENT DOCUMENTS 4,507,809 4/1985 Stepan ..... 2/424
4,612,675 9/1986 Broersma .
4,860,389 8/1989 Morin ..... 2/424

FOREIGN PATENT DOCUMENTS 2584898 1/1987 France .
3229430 3/1983 Germany .
1087123 6/1989 Japan .
1586377 3/1981 United Kingdom .

*Primary Examiner*—Michael A. Neas
*Attorney, Agent, or Firm*—Collard & Roe, P.C.

[57] ABSTRACT

A crash helmet having a protective shell with a large front opening for visibility covered by a visor. A horizontal slot below the front opening defines a sliding and guide seat. A sliding element has a pin which is disposed within the slot for horizontally moving the sliding element. The sliding element has a restraining element which faces the element. The lower edge of the visor includes a step portion facing away from the helmet. The step portion is positively engaged by the restraining element in the lowered position. The sliding element is movable to release and raise the visor.

5 Claims, 2 Drawing Sheets

CRASH HELMET FOR MOTORCYCLISTS AND THE LIKE, PROVIDED WITH A SAFETY DEVICE FOR LOCKING THE VISOR

BACKGROUND OF THE INVENTION

1. Field Of the Invention

This invention relates to a crash helmet for motorcyclists and the like, with a pivoting visor. More particularly, it relates to a device for locking the visor in a lowered position or maintaining the visor in a slightly open position.

2. The Prior Art

Crash helmets are known for motorcyclists and in general for those who take part in sports competition requiring the use of the helmet. These crash helmets are in the form of a full cap, which in the case of integral helmets is equipped with a visor opening for the eyes which can be closed by means of a liftable and/or removable transparent visor. At present, to keep the visor lowered, pins or ring nuts are provided at the sides of the helmet cap, on which the ends of the visor are rotatably hinged. Devices are provided where screwing a head, the visor ends are tightened against the ring nut, whereby the visor keeps its position by friction. Alternatively, devices are provided for plugging restraint means of the visor end into seats provided in the suitably shaped ring nut, or other similar devices.

These known devices realize an efficacious restraint of the visor in the closed position, but have the drawback of being placed laterally on the helmet. For their operation one cannot use either hand indifferently, but must use either the left or the right hand, and sometimes both of them in succession, according to whether the device is positioned on the left side, right side, or on both sides. This may involve marked discomfort particularly when the concerned hand is engaged in maneuvers from which it cannot be diverted (maneuvers of the clutch, the lights, etc.). The attention required to drive a fast sport vehicle may not allow the wearer sufficient time to determine if the locking device is locked or unlocked when he wishes to lift the visor. Therefore, the wearer tends to check the locking device which can distract him, even though for a few seconds, from the controls of the vehicle.

Besides, the locking devices of the prior art do not allow the visor to be locked in a slightly lifted position allowing a thin slit to remain open to obtain direct ventilation at low speeds. To operate the locking devices which are positioned at the ends of the visor, the arm would require too great a locking strain by the head on the ring nut, which is not easily realizable by the commonly utilized fastening means. Another drawback is that the aforementioned devices are generally complex and are therefore subject to rapid deterioration and breakdowns, besides being rather expensive.

SUMMARY OF THE INVENTION

It is therefore an object of this invention to provide a helmet for motorcyclists and the like provided with a locking device for the visor which is easily operable by only one hand and indifferently by the right or the left hand, causing it to be accessible and operable promptly and at any moment and in any condition.

A further object of this invention is to provide a crash helmet which is highly reliable and safe, without complex parts or mechanisms which is resistant to deterioration and accidental breakdowns, and which is simply and economically realizable.

Still another object of this invention is to provide a crash helmet provided with a device to lock and keep the visor in a slightly lifted position, so as to allow light direct ventilation at low speeds with the associated visor demisting effect.

These and still further objects and associated advantages which shall be stressed by the following description are provided by a crash helmet for motorcyclists and for sports-activities of any kind, of the type with a liftable visor, comprising a protective cap or shell provided on the front, in correspondence of the eyes, with a wide opening to ensure user's visibility, the helmet comprises a groove with guide rails or through slot, positioned near the lower edge of the opening, suitable to constitute a sliding and guide seat for a pin, guide head or the like. A translatable sliding element, provided with a pin or a guide head sliding in the groove has a protruding flange provided with a restraint tooth on the back. A liftable visor is provided with a protruding flap extending from its lower edge. The flap is provided on its front part with a step suitable to be positively engaged in the lowered position, by the restraint tooth. The length of the slot allows the sliding element to translate in both directions and to be stopped when the step is in a position of engagement to lock the lowered visor, or in a disengaged position.

The protruding flange is further provided on the top with a support seat suitable to cause the lower base of the protruding flap to rest on it, and therefore to keep in a slightly lifted position so as to ensure a moderate direct ventilation inside the helmet, in particular at low speeds. More particularly, the sliding element moves within an indented seat, provided below the lower edge of the opening and surrounding the groove or window. The protruding flap is housed in a special indented seat provided in the lower edge of the opening when the visor is fully lowered. The guide pin is provided with a head or a rivet, which restrains the pin and prevents it from coming out of the through slot. According to a variant of this invention the translatable sliding element is connected to a prestressed spring which brings always back the element to the position corresponding to the position of locking of the visor, even when the visor is free and lifted. This provides the locking device with greater safety and an even higher comfort level.

Normally the extension of the groove or the guide slit is such as to allow the sliding element to translate and to stop in two positions, a visor locking position and an unlocking position. If one wishes to obtain a moderate direct ventilation within the helmet, however, the visor is partly lifted. The protruding flange is positioned to rest on the support seat provided on the upper end of the flange. In this way, the visor remains lifted a few millimeters, i.e. a height about equal to the length of the flange. Of course the extension of the groove may be such as to allow the sliding element to have three positions, namely a position for locking or supporting the visor, and two unlocking positions or vice versa, for a greater comfort level.

BRIEF DESCRIPTION OF THE DRAWINGS

The subject matter of this invention is now described with reference to the enclosed drawings, which are given only as an illustration, and not as limitation of the invention, wherein.

DETAILED DESCRIPTION OF THE PREFERRED EMBODIMENTS

Figure 1:
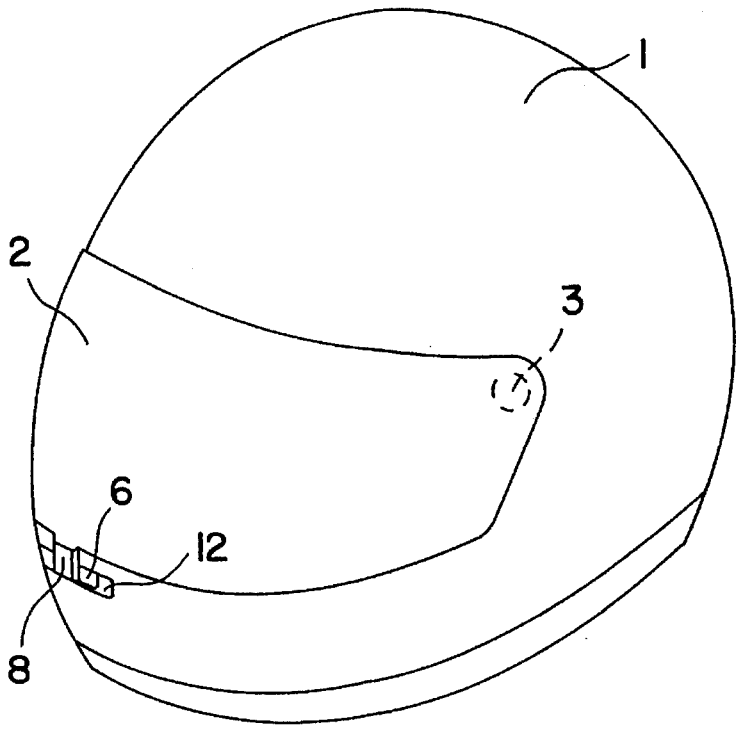
FIG. 1 is a perspective view of a helmet according to the invention.
Figure 2:
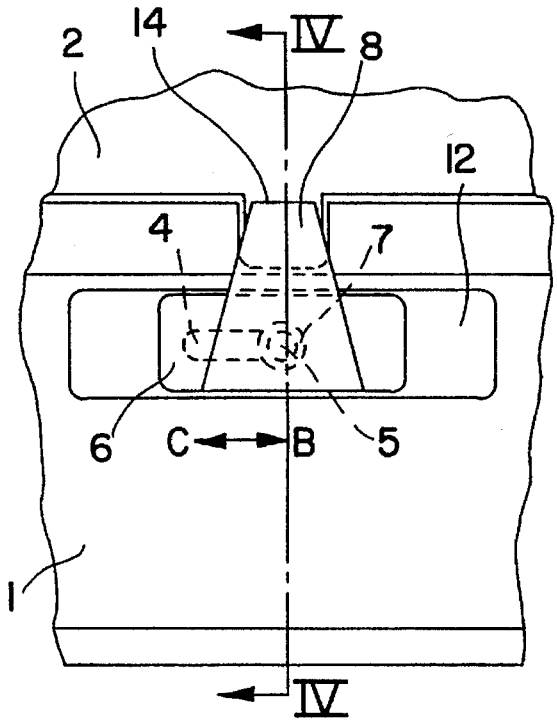
FIG. 2 is an enlarged front elevation view of the visor restraint and locking device of the invention with the visor lowered and locked.
Figure 3:
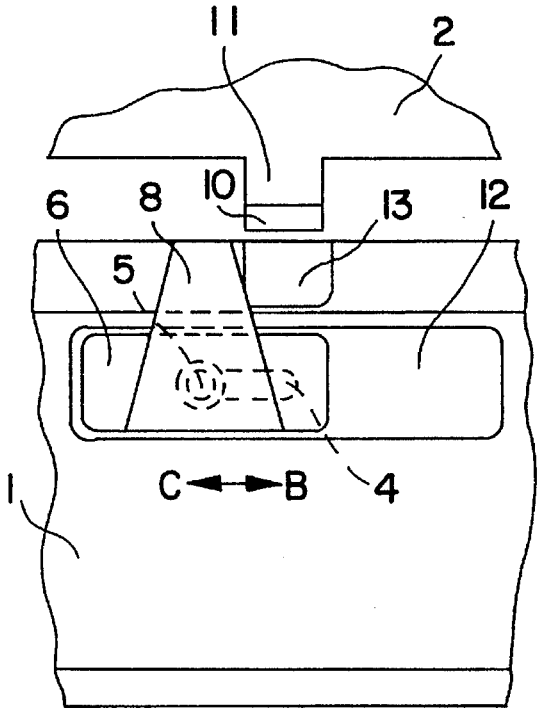
FIG. 3 is another enlarged front elevational view with the visor unlocked and disengaged.
Figure 4:
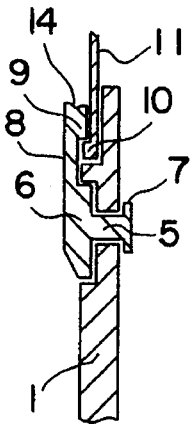
FIG. 4 is a cross-sectional view taken along the line A—A from FIG. 2 in the locked position.

With reference to FIGS. 1–4, there is shown a helmet according to the invention comprising a protective shell 1 to which a transparent visor 2 is liftable by rotation on hinge ring nuts 3. Near the lower edge of the visor opening, there is provided a through slit 4 which constitutes a sliding and guide seat for a pin 5 which is integral with the translatable sliding element 6.

Pin 5 is provided with a head or rivet 7 which prevents pin 5 from coming out of slit 4. Sliding element 6 is provided with a protruding locking flange 8, which includes a restraint tooth 9 on the back side. In the locked position shown in FIGS. 2 and 4, tooth 9 engages and restrains steps 10 provided on a protruding flap 11 of visor 2. Sliding element 6 translates in both directions within the indented seat 12, as indicated by arrow C-B. Flap 11 is housed in the lowered position within another seat 13, also provided on the edge of the opening of cap 3.

When sliding element 6 is shifted in direction C until pin 5 stops against the left end of slit 4, restraint tooth 9 disengages from step 10 and the visor is therefore disengaged and can be lifted. If sliding element 6 is shifted in direction B when the visor is lowered and flap 11 is housed within seat 13, tooth 9 superposes to step 10 and locks it and the visor in the closed lowered position. When a prestressed spring—not shown in the drawing—is coupled to element 6, the spring brings element 6 always back to position B, both when the visor is locked in the lowered position and after the visor is unlocked and lifted. On the contrary, by shifting element 6 towards B with the visor lifted and by aligning the locking flange 8 with protruding flap 11, the lower base of flap 11 can stop and rest on an upper end 14 of the protruding flange. In this way the visor remains partly lifted, leaving an opening through which a moderate amount of air can pass inside the helmet at low speeds.

Figure 5:
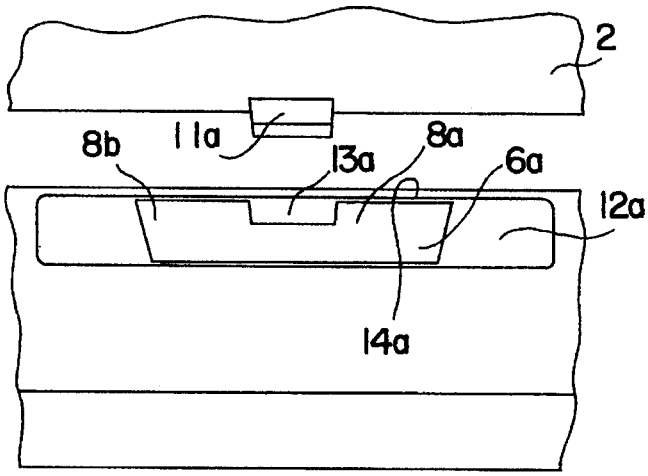
FIG. 5 is a front elevational view of a further embodiment of the invention, in which the sliding element is provided with two protruding flanges, with the device in the unlocking and disengagement position of the visor.

In the embodiment of FIG. 5, the translatable sliding element **6*a* is provided with two flanges 8*a* and 8*b***.

Figure 6:
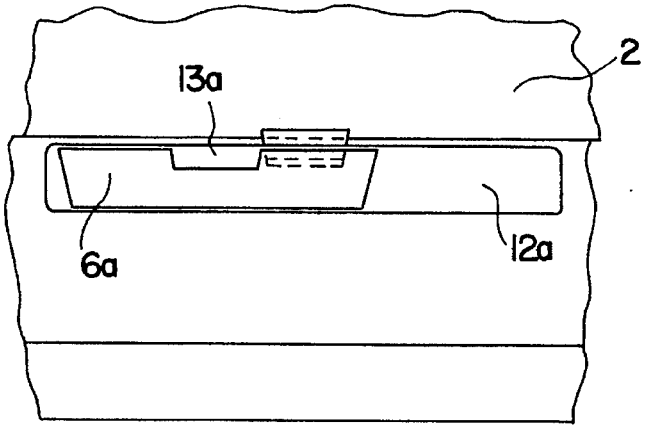
FIG. 6 is a front elevational view with the visor lowered and locked.
Figure 7:
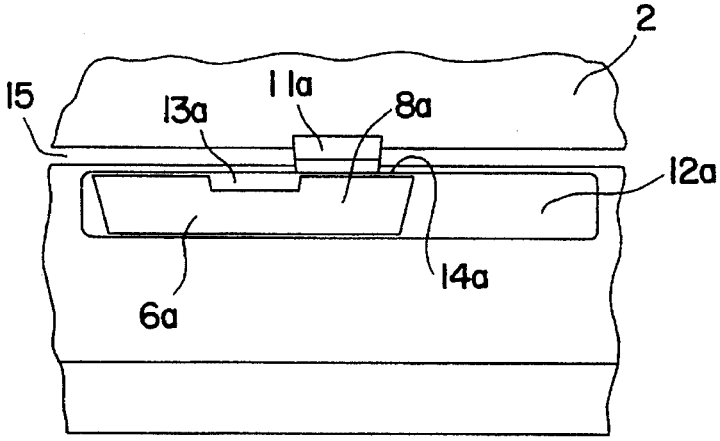
FIG. 7 is a front elevational view with the visor's protruding flap resting on the support seat provided on the flange of the translatable sliding element.

When sliding element **6*a* is in the central position in the indented seat 12*a*, flap 11*a* is free and the visor can be lifted. To lock the visor in the closed position, element 6*a* is shifted laterally while visor 2 is lowered and flap 11*a* is positioned in seat 13*a*, as shown in FIG. 6. On the contrary, by laterally shifting element 6*a* with the visor remains lifted and by causing the lower portion of flap 11*a* to be aligned with a support seat 14*a* provided on element 6*a*, the visor remains partially raised, leaving an open slit 15**, through which air can freely enter into the helmet.

I claim:

1. A crash helmet for participants in sports activities comprising:

a protective shell with a large front opening for visibility having a lower edge and a horizontal slot below said lower edge defining a sliding and guide seat;

a horizontally-movable sliding element having a guide pin disposed within the slot for guided horizontal movement therein and a flange having a restraining element facing the helmet, said sliding element having a first terminal position and a second terminal position at opposite ends of the slot; and a visor, mounted to said protective shell and pivotable between a lowered position covering the front opening and a raised position exposing the front opening, said visor having a lower edge and a downwardly-extending flap protruding from said lower edge, said flap having a step portion facing away from the helmet for positive engagement with said restraining element in the lowered position, when said visor is in said lowered position, said sliding element positively engages said step in said first terminal position, and upon movement of said sliding element to said second terminal position, said step is disengaged.

2. The crash helmet according to claim 1, wherein said flange includes a top defining a support seat for supporting said flap of said visor and for keeping said visor slightly raised so that moderate direct ventilation is provided within the helmet.

3. The crash helmet according to claim 1, wherein said protective shell has (i) a first indented seat portion below the lower edge which surrounds the slot for accommodating horizontal movement of said sliding element, and (ii) a second indented seat portion disposed between said lower edge and said first indented seat portion for accommodating said flap when said visor is in the lowered position.

4. The crash helmet according to claim 1, wherein said guide pin includes a head portion for retaining said pin within the slot and preventing said pin from exiting the groove.

5. A crash helmet for participants in sports activities comprising:

a protective shell with a large front opening for visibility having a lower edge and a horizontal slot below said lower edge defining a sliding and guide seat;

a horizontally-movable sliding element having a guide pin disposed within the slot for guided horizontal movement therein and a flange having a restraining element facing the helmet, said sliding element having a first terminal position and a second terminal position at opposite ends of the slot, said sliding element further having a center position between said first and second terminal positions; and a visor mounted to said protective shell and pivotable between a lowered position covering the front opening and a raised position exposing the front opening, said visor having a lower edge and a downwardly-extending flap protruding from said lower edge, said flap having a step portion facing away from the helmet for positive engagement with said restraining element in the lowered position, when said visor is in said lowered position, said sliding element positively engages said step in said center position, and upon movement of said sliding element to one of said terminal positions, said step is disengaged.

* * * * *